US006627369B2

(12) United States Patent
Kobayashi et al.

(10) Patent No.: US 6,627,369 B2
(45) Date of Patent: Sep. 30, 2003

(54) CARRIER FOR ELECTROPHOTOGRAPHIC DEVELOPER AND DEVELOPER CONTAINING THE SAME

(75) Inventors: Hiromichi Kobayashi, Kashiwa (JP); Tsuyoshi Itagoshi, Kashiwa (JP); Yasuhiko Kataoka, Kashiwa (JP); Yuji Sato, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 0 days.

(21) Appl. No.: 10/059,004

(22) Filed: Jan. 30, 2002

(65) Prior Publication Data

US 2002/0177061 A1 Nov. 28, 2002

(30) Foreign Application Priority Data

Mar. 30, 2001 (JP) ..... 2001-099812

(51) Int. Cl.[7] ..... G03G 9/083
(52) U.S. Cl. ..... 430/111.32; 430/111.41
(58) Field of Search ..... 430/111.41, 111.32

(56) References Cited

U.S. PATENT DOCUMENTS 4,977,054 A * 12/1990 Honjo et al. ..... 430/108
5,849,452 A * 12/1998 Takenaka et al. ..... 430/122
6,187,490 B1 * 2/2001 Taya et al. ..... 430/45

FOREIGN PATENT DOCUMENTS

| | | |
|---|---|---|
| EP | 0 351 712 | 1/1990 |
| EP | 0 430 793 | 6/1991 |
| EP | 1 037 118 | 9/2000 |
| GB | 2 139 371 | 11/1984 |
| JP | 59-104663 | 6/1984 |
| JP | 4-3868 | 1/1992 |
| JP | 06-051563 | 2/1994 |
| JP | 06-332237 | 12/1994 |
| JP | 07-175264 | 7/1995 |
| JP | 07-175265 | 7/1995 |
| JP | 2001027828 | 1/2001 |

* cited by examiner

*Primary Examiner*—John Goodrow
(74) *Attorney, Agent, or Firm*—Young & Thompson

(57) ABSTRACT

A carrier for an electrophotographic developer which has a flowability index F1, represented by formula (1), of 63 to 75 sec/(50·cm$^3$) and a flowability index F2, represented by formula (2), of 30 to 100 Oe·g/cm$^3$:

$$F1=AD\times FR \quad (1)$$

$$F2=AD\times Hc \quad (2)$$

wherein AD is an apparent density (g/cm$^3$); FR is a flow rate (sec/50 g); and Hc is a coercive force (Oe).

12 Claims, 1 Drawing Sheet

CARRIER FOR ELECTROPHOTOGRAPHIC DEVELOPER AND DEVELOPER CONTAINING THE SAME

FIELD OF THE INVENTION

The present invention relates to a carrier to be mixed with a toner to provide a two-component developer for electrophotography and a developer containing the carrier.

BACKGROUND OF THE INVENTION

A two-component dry developer for electrophotography comprises a toner and a carrier. The carrier is mixed with the toner in a mixing zone of a developing machine to give a desired charge quantity to the toner and carries the charged toner onto an electrostatic latent image formed on a photoreceptor to form a toner image. The developer is replenished with a supplementary amount of a fresh toner for repeated use.

Applications of the developer of this type have been diversified with the wide spread of electrophotographic recording apparatus such as copiers, facsimiles and printers. In particular, market demands for higher image quality and a longer developer life have been increasing. With continued reduction in prices, a demand for size reduction of the recording apparatus is also growing.

To meet the demand for higher image quality, reduction of a toner particle size has been proposed. Since toner particle size reduction tends to be accompanied by reduction of chargeability, it is necessary for the carrier to have a reduced particle size to gain in specific surface area for imparting a sufficient charge quantity to the toner. However, a carrier with a smaller size has poorer flowability and is slower in triboelectrically charging a toner, resulting in a slower rise of charges, which can cause such problems as toner scattering.

Intensified mixing has been suggested to improve the flowability, which increases the stress on the developer. An increased stress will induce a so-called spent-toner phenomenon (adhesion of a toner to the surface of the carrier particles) and cause the resin coat to fall off the carrier core, thereby accelerating deterioration of the developer. As a result, the developer cannot maintain satisfactory developing performance for a long period of time.

Further, the recent tendency toward size reduction of recording apparatus has necessitated fulfillment of the above-mentioned demands for high image quality and a long life with a reduced amount of a developer. Size reduction of recording apparatus has also made it difficult to arrange sufficient members such as flow regulators in the mixing zone and the part of feeding a developer to a sleeve. Hence, it has been desired to make a developer which exhibits rapid triboelectric charging properties on mixing carrier and toner under such a stress that does not cause developer deterioration and which forms a uniform and soft magnetic brush on a sleeve.

Developers which have hitherto been proposed for high image quality, prevention of carrier adhesion to a photoreceptor (hereinafter simply referred to as carrier adhesion), and extension of a service life and appear relevant to the present invention are discussed below.

JP-A-59-104663 proposes a carrier having a saturation magnetization of 50 emu/g or less. However, merely decreasing saturation magnetization of a carrier leads to reduction of adhesion force to a magnet roller so that the carrier is not sufficiently prevented from being attached to a photoreceptor.

JP-B-4-3868 proposes a developer containing a so-called hard ferrite having a coercive force of 300 Gauss or more as a carrier. In using the developer, it is preferred that a recording apparatus, especially the magnet roller or the sleeve thereof, be designed specially for the hard ferrite having such a high coercive force. Therefore, the developer is not fit for size reduction of the apparatus. Further, the carrier has poor transportability due to its high coercive force and is not sufficiently mixed with toner. As a result, rapid triboelectrification is not secured, allowing toner to scatter.

Japanese Patent 3,005,120 teaches that the above problems are solved by controlling the magnetization intensity and the rise of magnetization in a magnetic field of 1000 Oe but is still unsatisfactory in preventing carrier adhesion. Additionally, because the chains of carrier beads with attached toner (magnetic brush) are short, they hardly make a bridge between magnetic poles on a sleeve and are liable to come into contact with a photoreceptor while standing. That is, the magnetic brush is not soft enough to achieve high image quality.

JP-A-6-332237 proposes controlling developer flowability constant so as to improve developer transport properties. The inventors specify the flowability per unit weight. However, since a developer in an actual developing zone (i.e., on a sleeve) flows in a given capacity, sufficient effects are not obtained by the proposed flowability control. Further, where the residual magnetization and the coercive force are too low, the chains of carrier beads easily become too sparse to exert sufficient developing ability, and it is difficult to control the developer flowability in the developing zone, which makes it hard to retain high image quality for an extended period of time.

JP-A-7-175264 discloses a developer free from carrier adhesion and an edge effect, in which a carrier core having a controlled flowability and a controlled apparent density is coated with a non-uniform resin coat. Use of the proposed carrier core, however, turned out to result in deteriorated carrier flowability in a mixing zone. The carrier and a toner are not mixed sufficiently for adequate triboelectrification, and fog and toner scattering can result. This drawback is conspicuous in a smaller-sized apparatus.

JP-A-7-175265 describes a developer comprising a toner prepared through a specific suspension polymerization process and a carrier with controlled magnetic characteristics, which was proposed to secure environmental stability of developing performance and to obtain fog-free clear images. While the proposed carrier shows some effect on carrier adhesion, the degree of accomplishment is not enough to fulfill the recent market demands for alleviation of a spent-toner phenomenon and for high image quality. In addition, fog and toner scattering are not sufficiently prevented probably due to inadequate flowability in the mixing zone.

SUMMARY OF THE INVENTION

An object of the present invention is to provide a carrier for electrophotographic developer and a developer containing the carrier which exhibit satisfactory flowability in a mixing zone and on a sleeve, are free from carrier adhesion, toner scattering and fog, and provide high image quality in terms of image density, fine line or dot reproducibility, and the like.

The present inventors have extensively studied aiming at alleviation of carrier adhesion and toner scattering and improvement in image quality. As a result, they have found that the above object of the invention is accomplished by a developer with specific flowability.

The disadvantages accompanied with conceivable manipulations for obtaining high image quality are reviewed. The attempt of reducing the particle size of carrier and toner results in poor developer flowability and transport so that additional fresh toner is not rapidly triboelectrified by carrier, failing to produce a proper charge quantity. The insufficiently charged toner is transported to the sleeve as it is, which can cause fog or toner scattering. Intensified mixing for improving the rise of charging increases the stress on the developer, which can cause fall-off of the resin coat from coated carrier particles or a spent-toner phenomenon. Variations in charge quantity and developer resistance follow, leading to reduction of the developer service life. If an increased amount of a fluidizing agent is added to toner to improve the developer flowability thereby to accelerate the rise of charging, the fluidizing agent itself adheres to the carrier surface, which also leads to deterioration of the developer. Should the flowability be increased too much, localization of the developer will occur, failing to form a uniform magnetic brush on a sleeve. For example, the image density may differ between the upstream end and the downstream end.

It is an effective manipulation to decrease the magnetization of carrier so as to form a soft magnetic brush for improving image quality. Nevertheless, this means alone is not only incapable of obtaining sufficient image quality but can cause carrier adhesion. With a reduced magnetization, it is difficult for chains of carrier beads to make a bridge between magnetic poles on a sleeve and to form a soft magnetic brush. Being sparse, the carrier chains are incapable of supplying sufficient toner, resulting in a reduced image density. Increasing the coercive force of carrier to solve these problems is effective to obtain a sufficient image density, making the carrier chains denser and letting the carrier chains form arches over magnetic poles on a sleeve. However, too strong a coercive force rather results in formation of hard chains, causing image quality deterioration. It can also impair developer flowability on the sleeve, making toner supply poor, resulting in a failure of providing a sufficient image density. Further, an increased coercive force tends to continue influencing even after separation from the sleeve such that carrier particles are not easily disintegrated and mixed up with toner in a mixing zone. This will cause toner scattering or fog as stated above.

This being the case, it is important to control flowability of a developer in both a mixing zone having no magnetic field and a developing zone (on a sleeve) influenced by a magnetic field. Seeing that a developing unit has a definite capacity, the present inventors found it significant to properly control the flowability of a developer, especially a carrier, per unit volume.

Based on the above finding, the present invention provides a carrier for an electrophotographic developer which has a flowability index F1, represented by formula (1), of 63 to 75 sec/(50·cm$^3$) and a flowability index F2, represented by formula (2), of 30 to 100 Oe·g/cm$^3$:

$$F1 = AD \times FR \quad (1)$$

$$F2 = AD \times Hc \quad (2)$$

wherein AD is an apparent density (g/cm$^3$); FR is a flow rate (sec/50 g); and Hc is a coercive force (Oe).

The present invention also provides an electrophotographic developer comprising the above-described carrier and a toner.

Having appropriately controlled powder flow behavior which is specified in terms of flowability per unit volume in, and out of, a magnetic field, the carrier and the developer of the present invention exhibit satisfactory flow and transportability both in a mixing zone (with toner) and on a sleeve, achieve rapid triboelectrification with a sharp rise in the mixing zone, and form a uniform, soft and dense magnetic brush on the sleeve. Therefore, they are capable of providing high quality images free from fog without being accompanied with toner scattering and carrier adhesion for a prolonged period of time.

BRIEF DESCRIPTION OF THE DRAWINGS

The present invention will be more particularly described with reference to the accompanying drawings, in which.

DETAILED DESCRIPTION OF THE PREFERRED EMBODIMENTS

Figure 1:
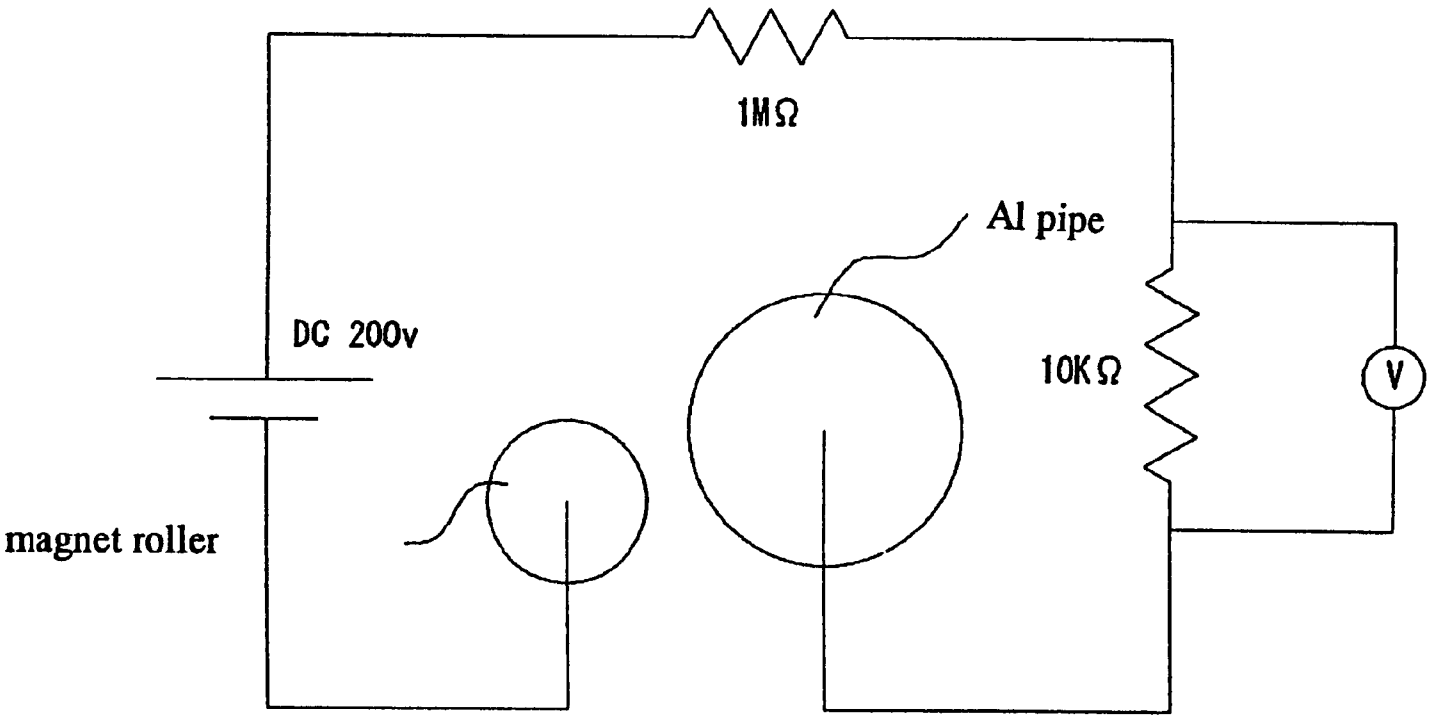
FIG. 1 is a schematic illustration of a current meter used to measure a current of carrier.

The carrier according to the present invention has a flowability index F1 of 63 to 75 sec/(50·cm$^3$). The F1, being represented by formula (1) shown below, indicates flowability per unit volume in a mixing zone where no influences of a magnetic field is exerted.

$$F = AD \times FR \quad (1)$$

wherein AD is an apparent density (g/cm$^3$), and FR is a flow rate (sec/50 g).

The carrier has an F1 of 63 to 75 sec/(50·cm$^3$), preferably 65 to 72 sec/(50·cm$^3$). An F1 less than 63 sec/(50·cm$^3$), which means too good flowability, easily results in localization of the developer and formation of non-uniform chains on the sleeve. It follows that an appreciable difference in image density is produced between areas corresponding to the upstream and downstream ends of the sleeve. With an F1 more than 75 sec/(50·cm$^3$), which means too poor flowability, i.e., poor transportability and difficult agitation, localization of the developer can occur, and the degree of toner and carrier mixing is insufficient to cause toner scattering and fog. Too high an F1 (too poor flowability) results in an increase of agitation stress, which leads to reduction of service life. Too low an F1 also leads to reduction of service life because the localized developer undergoes increased stress.

The carrier has a flowability index F2, represented by formula (2), of 30 to 100 Oe·g/cm$^3$.

$$F2 = AD \times Hc \quad (2)$$

wherein AD is as defined above, and Hc is a coercive force (Oe).

The F2 indicates flowability per unit volume on a sleeve where the carrier is under the magnetic influences. It is also indicative of the configuration of a magnetic brush formed on the sleeve and the length of chains of carrier particles (or the degree of formation of such chains that form a bridge over magnetic poles of the sleeve).

The carrier has an F2 of 30 to 100 Oe·g/cm$^3$, preferably 50 to 90 Oe·g/cm$^3$. If the F2 is less than 30 Oe·g/cm$^3$, the magnetic brush formed on the sleeve is too sparse to exert sufficient developing properties, and the carrier chains are hard and standing, which are no good for image quality. An F2 exceeding 100 Oe·g/cm$^3$ results in formation of a dense magnetic brush, but the developer has poor flowability on the sleeve, making non-uniform carrier chains, causing a short supply of toner and deteriorating the image quality. Too small an F2 results in formation of sparse and standing carrier chains. It follows that toner scattering can take place probably because of a failure to secure toner particles and that the carrier is apt to adhere to a photoreceptor probably because the chains stand with their free ends furnishing a weaker magnetic field. If the F2 is too large, on the other hand, the carrier chains are so hard, allowing the carrier particles to be adhered to a photoreceptor presumably because of strong contact with the photoreceptor.

The carrier preferably has a coercive force Hc of 12 to 60 Oe, particularly 30 to 55 Oe. Carrier particles whose coercive force is less than 12 Oe hardly form dense chains on a sleeve and can cause reduction of developing properties. Carrier particles having a coercive force exceeding 60 Oe show poor flowability on a sleeve, tending to result in a short supply of toner, i.e., poor developing properties. Further, particles having too high a coercive force are not easily disintegrated even after separating from the sleeve and are difficult to be mixed with an additional amount of toner.

The carrier preferably has a saturation magnetization of 20 to 45 emu/g in an applied magnetic field of 3000 Oe. Carrier particles having a lower saturation magnetization are liable to adhere to a photoreceptor, and those having a higher saturation magnetization tend to form too hard chains for obtaining high image quality.

The carrier preferably has a volume average particle size of 30 to 80 $\mu$m, particularly 35 to 60 $\mu$m. Smaller sizes are effective for high image quality but have a reduced magnetization per particle, which can cause carrier adhesion. Greater sizes result in a decreased specific surface area which may be insufficient for imparting sufficient charges to the toner and can cause deterioration of image quality.

The carrier preferably has an electric current of 5 $\mu$A or less, particularly 2 $\mu$A or less. A higher current than 5 $\mu$A, which means a lower resistance, brings about improved developing properties but can readily cause carrier adhesion.

Core materials which can be used in the carrier include, but are not limited to, iron, ferrites, and magnetite. Ferrites are preferred. Iron powder having a high saturation magnetization, while effective for preventing carrier adhesion, forms high and hard chains which may scrape off the toner once transported to a photoreceptor to cause brush marks. Iron powder having low resistance, the charges tend to leak to destroy the electrostatic latent image on a photoreceptor, also causing brush marks. Ferrites are generally represented by formula: $(MO)_x(Fe_2O_3)_y$, wherein M represents at least one of Cu, Zn, Fe, Mg, Mn, Ca, Li, Ti, Ni, Sn, Sr, Al, Ba, Co, Mo, etc.; and x and y represent a molar ratio satisfying x+y=100.

Ferrite core particles are prepared by, for example, the following method. Weighed oxide raw materials are mixed and ground in a wet ball mill for 10 hours, dried, and fired at 950° C. for 4 hours. The product is ground in a wet ball mill for 24 hours to a particle size of 5 $\mu$m or smaller. The resulting slurry is granulated. After drying, the granules are fired at 1300° C. for 6 hours in an atmosphere with a controlled oxygen concentration, ground, and classified to have a desired particle size distribution.

Methods for controlling the magnetization, residual magnetization, coercive force, apparent density and flow rate of carrier particles are not particularly limited. For example, these properties are controllable through selection of raw oxide materials and their compounding ratio or firing conditions (temperature, retention time and oxygen concentration). The magnetic properties are also controlled by oxidation in a selected furnace after the firing. The apparent density or flow rate are also controllable by a resin coat hereinafter described.

Various resins can be used to form a resin coat on the carrier core. Useful resins include fluorine resins, acrylic resins, epoxy resins, polyester resins, fluoroacrylic resins, acrylic styrene resins, silicone resins, acrylic resin-, polyester resin-, epoxy resin-, alkyd resin- or urethane resin-modified silicone resins, and crosslinkable fluorine-modified silicone resins. In selecting the coating resin, it should be taken into consideration that a resin coat is liable to fall off or wear or fuse to cause a spent-toner phenomenon under stress imposed due to collisions among particles in a mixing zone or against a doctor blade. In order to avoid these disadvantages and to maintain stabilized developer characteristics for a long time, resins having a unit represented by formula (I) and/or a unit represented by formula (II) are preferably used for their wear resistance, fall-off resistance, and fusion resistance.

(I)

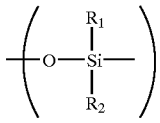

(II)

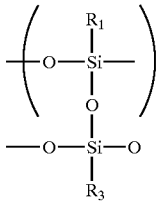

where $R_1$, $R_2$, and $R_3$ each represent a hydrogen atom, a halogen atom, a hydroxyl group, a methoxy group, an alkyl group having 1 to 4 carbon atoms or a phenyl group.

Resins having the unit of formula (I) and/or the unit of formula (II) include the above-recited straight silicone resins, organic group-modified silicone resins, and fluorine-modified silicone resins. The fluorine-modified silicone resins include crosslinking-curable fluorine-modified silicone resins obtained by hydrolyzing an organosilicone compound containing the unit (I) and/or (II) and a perfluoroalkyl group. The perfluoroalkyl-containing organosilicone compound includes $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF_3)_2CF(CF_2)_8CH_2\ CH_2Si(OCH_3)_3$.

Coating the core with the resin is carried out in a usual manner, for example, spread coating with a brush, powder coating, fluidized bed spray drying, a rotary dryer method, or dip coating by use of a universal agitator. A fluidized bed coating system is preferred for securing coverage.

If desired, a charge control agent, a resistance control agent or a fluidity control agent can be added to the coating resin. Examples of these additives include, but are not limited to, conductive carbon, borides (e.g., titanium boride), oxides (e.g., titanium oxide, iron oxide, aluminum oxide, chromium oxide and silicon oxide), titanium coupling agents, and silane coupling agents.

A preferred resin coating weight is 0.05 to 10.0%, particularly 0.5 to 7%, by weight based on the core. It is difficult to form a uniform coating film with a coating weight less than 0.05%. A coating weight exceeding 10.0% can induce agglomeration of coated carrier particles.

After coating, the coating film is baked, if desired, either by external heating or internal heating by means of, for example, a fixed bed or fluidized bed electric oven, a rotary kiln type electric oven, a burner oven, or a microwave oven.

The baking temperature depends on the resin and should be not lower than the melting point or glass transition point of the resin used. In using a heat-curing or condensation-curing resin, the baking temperature should be raised up to a point at which curing proceeds sufficiently.

The core thus coated with the resin and baked is cooled, disintegrated, and regulated in size to obtain a resin-coated carrier.

The carrier thus prepared is mixed with a toner to provide a two-component developer for electrophotography. The developer according to the present invention has a toner concentration of 1 to 10%, preferably 2 to 8%, by weight.

The toner which can be used in the present invention is prepared by known methods, such as a suspension polymerization method, an emulsion polymerization method, and a grinding method. The grinding method comprises thoroughly blending a binder resin, a colorant, a charge control agent, etc. in a mixing machine (e.g., a Henschel mixer), melt-kneading the blend in a twin-screw extruder, etc., cooling the molten mixture, pulverizing the mixture in a jet mill, etc. and classifying with an air classifier, etc. to obtain a toner of desired particle size. If desired, a wax, magnetic powder, a viscosity modifier and other additives can be incorporated into the toner. After classification, external additives can be added.

The polymerization method is carried out by, for example, as follows. An aqueous colorant dispersion containing a surface active agent and an emulsified dispersion of a monomer(s), a surface active agent and a polymerization initiator in an aqueous medium are mixed by stirring. A flocculant is added to the reaction mixture to cause salting out. The precipitated particles are collected by filtration, washed and dried to obtain toner particles, to which external additives are added.

A fixability improver and/or a charge control agent can be incorporated into the toner to improve various toner characteristics. A chain transfer agent can be used in the polymerization system to assist emulsification and to control the molecular weight of the resultant polymer.

The binder resin which can be used in the toner includes, but is not limited to, polystyrene, chloropolystyrene, styrene-chlorostyrene copolymers, styrene-acrylic ester copolymers, styrene-methacrylic acid copolymers, rosin-modifed maleic acid resins, epoxy resins, polyester resins, polyethylene resins, polypropylene resins, polyurethane resins, and silicone resins. These binder resins can be used either individually or as a combination thereof.

The charge control agent which can be used in the toner includes nigrosine dyes, quaternary ammonium salts, organometal complexes, chelate complexes, and metallized monoazo dyes.

Any well-known dyes and/or pigments are used as a colorant. Examples of suitable colorants are carbon black, Phthalocyanine Blue, Permanent Red, Chrome Yellow, and Phthalocyanine Green.

External additives for the toner include silica, hydrophobilized silica, titanium oxide, hydrophobilized titanium oxide, barium titanate, fluoropolymer particles, acrylic resin particles, and mixtures thereof.

The characteristics of the carrier were measured as follows.

1) Apparent Density

Measured in accordance with JIS Z2504 (Determination of apparent density—funnel method).

2) Flow Rate

Measured in accordance with JIS Z2502 (Determination of flowability by means of a calibrated funnel (Hall flowmeter)).

3) Magnetic Characteristics

Read from a hysteresis loop prepared with a B-H loop tracer Model BHU-60 supplied by Riken Denshi Co., Ltd. in an applied magnetic field of 3000 Oe.

4) Volume Average Particle Size

Measurement was made with a particle size analyzer MICROTRAC 9320-X100, available from Nikkiso Co., Ltd.

5) Electric Current

Measurement was made using an current meter having a magnet roller and an aluminum pipe as probes set at 4.5 mm apart as shown in FIG. 1 with an applied voltage of 200 V. A carrier sample weighing 800 g was measured after exposure in an environment of 20 to 26° C. and 50 to 60% RH for at least 15 minutes.

The present invention will now be illustrated in greater detail with reference to Examples and Comparative Examples, but it should be understood that the invention is not construed as being limited thereto.

EXAMPLE 1

Raw materials were compounded to give a composition having an MnO content of 20.0 mol % and an $Fe_2O_3$ content of 80.0 mol % and wet ground with water in a ball mill for 10 hours. After drying, the blend was kept at 950° C. for 4 hours and again wet ground in a ball mill for 24 hours. The resulting slurry was granulated and dried. The granules were kept at 1300° C. for 6 hours in a nitrogen atmosphere, followed by disintegration and classification. The particles were oxidized in a rotary kiln at 1000° C. to obtain manganese ferrite particles as a core. The resulting core particles had an average particle size of 50 $\mu$m and a saturation magnetization of 32 emu/g, a residual magnetization of 3 emu/g, and a coercive force of 36 Oe in an applied magnetic field of 3000 Oe.

A hundred gram (on a solid basis) of a silicone resin SR-2411, available from Dow Corning Toray Silicone Co., Ltd., was weighed out and dissolved in 1000 ml of toluene. The silicone resin solution was sprayed onto 10 kg of the ferrite particles by use of a fluidized bed coating apparatus. The rate of spraying was adjusted so that spraying completed in 45 minutes. The coating layer was baked at 220° C. for 2 hours to obtain a carrier, designated carrier 1. Carrier 1 had a current of 0.04 $\mu$A an F1 of 67.2 sec/(50·cm$^3$), and an F2 of 86.8 Oe·g/cm$^3$ as shown in Table 1 below.

Carrier 1 and a polyester toner were mixed in a Naughter mixer for 30 minutes to prepare a developer having a toner concentration of 5 wt %. The developer was tested on a printer KL-3015, supplied to Konica Corp. The results revealed that the developer showed satisfactory flowability and transportability in both the mixing zone and on the sleeve and that the magnetic brush formed on the sleeve was soft and dense. Neither toner scattering nor carrier adhesion was observed. Localization of the developer did not occur, and very good toner images were obtained for a long period of time.

Table 2 shows the results of the copying test in terms of developer localization, toner scattering, image quality, service life, carrier adhesion, and overall judgement. The standards of evaluation are shown below.

a) Developer Localization

Unevenness of image density was observed with the naked eye.

A . . . Imperceptible

B . . . Slightly perceptible but acceptable

C . . . Perceptible

D . . . Definitely perceptible b) Toner Scattering

Observed with the naked eye.

A . . . Almost not observed

B . . . Observed but acceptable

C . . . Unacceptably observed

D . . . Considerably observed c) Image Quality

A . . . Very good resolution with satisfactory gradation and clear fine lines

B . . . Satisfactory in gradation and fine line reproducibility (resolution)

C . . . Poor gradation and vague fine lines

D . . . Very poor gradation and plugging between fine lines d) Service Life

A continuous copying test was carried out.

A . . . Image quality does not change in producing 100,000 copies.

B . . . Image quality does not change in producing 50,000 copies. Deterioration of image quality occurs between 50,000 and 100,000 copies.

C . . . Deterioration of image quality occurs in producing 30,000 copies.

D . . . Considerable deterioration of image quality occurs in producing 5,000 copies.

e) Carrier Adhesion

The number of white spots (due to adhesion of carrier particles to the photoreceptor) on images was counted.

A . . . Nil on 10 copies of A4 size

B . . . 1 to 5 on 10 copies of A4 size

C . . . 6 to 10 on 10 copies of A4 size

D . . . 11 or more on 10 copies of A4 size f) Overall Judgement

The attributes (a) to (e) were overall evaluated.

A . . . Excellent

B . . . Good

C . . . Acceptable

D . . . Unacceptable

In Examples 2 to 4 and Comparative Examples 1 to 4, carriers were prepared under the described conditions, the resulting carrier was mixed with a toner in the same manner as in Example 1 to prepare a developer, and the developer was tested in the same manner as in Example 1. The characteristics of the carriers and the copying test results obtained are shown in Tables 1 and 2, respectively.

EXAMPLE 2

Raw materials were compounded to give a composition having an MnO content of 10.0 mol %, an MgO content of 39 mol %, an $Fe_2O$, content of 48.0 mol %, an SnO content of 1 mol %, and an SrO content of 2 mol % and wet ground with water in a ball mill for 10 hours. After drying, the blend was kept at 950° C. for 4 hours and again wet ground in a ball mill for 24 hours. The resulting slurry was granulated and dried. The granules were kept at 1260° C. for 6 hours in the air, followed by disintegration and classification to obtain ferrite particles as a core.

A silicone resin SR-2411, available from Dow Corning Toray Silicone Co., Ltd., weighing 250 g (on a solid basis) was dissolved in 1000 ml of toluene. The ferrite core weighing 10 kg was coated with the silicone resin solution in a Henschel mixer and baked at 220° C. for 2 hours to obtain carrier 2.

EXAMPLE 3

Raw materials were compounded to give a composition having an MnO content of 10.0 mol %, an MgO content of 39 mol %, an $Fe_2O_3$ content of 47.5 mol %, an SnO content of 1 mol %, and an SrO content of 2.5 mol % and wet ground with water in a ball mill for 10 hours. After drying, the blend was kept at 950° C. for 4 hours and again wet ground in a ball mill for 24 hours. The resulting slurry was granulated and dried. The granules were kept at 1260° C. for 6 hours in the air, followed by disintegration and classification to obtain ferrite particles as a core.

An acryl-modified silicone resin KR-9706, available from Shin-Etsu Chemical Co., Ltd., weighing 250 g (on a solid basis) was dissolved in 1000 ml of toluene. The ferrite core weighing 10 kg was coated with the resin solution in a Henschel mixer and baked at 220° C. for 2 hours to obtain carrier 3.

EXAMPLE 4

Carrier 4 was prepared in the same manner as in Example 3, except for changing the $Fe_2O_3$ content of the raw material composition to 46.5 mol % and the SrO content of the raw material composition to 1.5 mol %.

Comparative Example 1

Raw materials were compounded to give a composition having an MnO content of 39.7 mol %, an MgO content of 9.9 mol %, an $Fe_2O_3$ content of 49.6 mol %, and an SrO content of 0.8 mol % and wet ground with water in a ball mill for 10 hours. After drying, the blend was kept at 950° C. for 4 hours and again wet ground in a ball mill for 24 hours. The resulting slurry was granulated and dried. The granules were kept at 1285° C. for 6 hours in the air, followed by disintegration and classification to obtain ferrite particles as a core.

An acrylic resin BR-80, available from Mitubishi Rayon Co., Ltd., weighing 50 g (on a solid basis) was dissolved in 1000 ml of toluene. The ferrite core weighing 10 kg was coated with the resin solution in a HENSCHEL MIXER and baked at 145° C. for 2 hours to obtain carrier 5.

Comparative Example 2

Raw materials were compounded to give a composition having an MnO content of 39.7 mol %, an MgO content of 9.9 mol %, an $Fe_2O_3$ content of 49.6 mol %, and an SrO content of 0.8 mol % and wet ground with water in a ball mill for 10 hours. After drying, the blend was kept at 950° C. for 4 hours and again wet ground in a ball mill for 24 hours. The resulting slurry was granulated and dried. The granules were kept at 1285° C. for 6 hours in an atmosphere having an oxygen content of 3%, followed by disintegration and classification to obtain ferrite particles as a core.

An acryl-modified silicone resin KR-9706, available from Shin-Etsu Chemical Co., Ltd., weighing 50 g (on a solid basis) was dissolved in 1000 ml of toluene. The ferrite core weighing 10 kg was coated with the resin solution in a Henschel mixer and baked at 220° C. for 2 hours to obtain carrier 6.

Comparative Example 3

Raw materials were compounded to give a composition having an MnO content of 8 mol %, an MgO content of 32 mol %, an $Fe_2O_3$ content of 49 mol %, an SnO content of 1 mol %, and an SrO content of 10 mol % and wet ground with water in a ball mill for 10 hours. After drying, the blend was kept at 950° C. for 4 hours and again wet ground in a ball mill for 24 hours. The resulting slurry was granulated and dried. The granules were kept at 1285° C. for 6 hours in the air, followed by disintegration and classification to obtain ferrite particles as a core.

An acrylic resin BR-80, available from Mitsubishi Rayon Co., Ltd., weighing 50 g (on a solid basis) was dissolved in 1000 ml of toluene. The ferrite core weighing 10 kg was coated with the resin solution in a HENSCHEL MIXER and baked at 145° C. for 2 hours to obtain carrier 7.

Comparative Example 4

The same ferrite core prepared in Comparative Example 2 was coated with a solution of 50 g (on a solid basis) of an acrylic resin BR-80, available from Mitubishi Rayon Co., Ltd., in 1000 ml of toluene in a HENSCHEL MIXER and baked at 145° C. for 2 hours to obtain carrier 8.

TABLE 1

| | Saturated Magnetization (emu/g) | Residual Magnetization (emu/g) | Coercive Force (Oe) | Current ($\mu$A) | Vol. Avg. Particle Size ($\mu$m) | Apparent Density (g/cm$^3$) | Flow Rate (sec/50 g) | F1 | F2 |
|---|---|---|---|---|---|---|---|---|---|
| Example 1 | 32 | 3 | 36 | 0.04 | 51.4 | 2.41 | 27.9 | 67.2 | 86.8 |
| Example 2 | 34 | 7 | 48 | 0.72 | 50.6 | 1.81 | 38.1 | 69.0 | 86.9 |
| Example 3 | 30 | 8 | 54 | 0.60 | 47.6 | 1.66 | 44.0 | 73.0 | 89.6 |
| Example 4 | 31 | 6 | 30 | 0.40 | 48.4 | 1.63 | 42.3 | 68.9 | 48.9 |
| Comparative Example 1 | 57 | 2 | 12 | 0.52 | 52.3 | 2.15 | 34.3 | 73.7 | 25.8 |
| Comparative Example 2 | 64 | 2 | 10 | 0.71 | 49.5 | 2.15 | 35.8 | 77.0 | 21.5 |
| Comparative Example 3 | 34 | 1 | 10 | 0.27 | 49.9 | 1.94 | 32.1 | 62.3 | 19.4 |
| Comparative Example 4 | 28 | 12 | 75 | 1.25 | 56.1 | 1.72 | 34.8 | 59.9 | 129.0 |

TABLE 2

| | Developer Localization | Toner Scattering | Image Quality | Service Life | Carrier Adhesion | Overall Judgement |
|---|---|---|---|---|---|---|
| Example 1 | A | A | A | A | A | A |
| Example 2 | A | A | A | A | A | A |
| Example 3 | B | A | A | B | B | B |
| Example 4 | B | B | B | B | B | B |
| Comparative Example 1 | B | C | D | C | C | C |
| Comparative Example 2 | C | D | D | C | C | C |
| Comparative Example 3 | D | D | D | C | D | D |
| Comparative Example 4 | D | D | D | D | D | D |

As shown in Table 2, the developers of Examples 1 to 4 are superior to those of Comparative Examples 1 to 4 in all the attributes evaluated.

What is claimed is:

1. A carrier for an electrophotographic developer which has a flowability index F1, represented by formula (1), of 63 to 75 sec/(50·cm$^3$) and a flowability index F2, represented by formula (2), of 30 to 100 Oe·g/cm$^3$:

$$F1 = AD \times FR \quad (1)$$

$$F2 = AD \times Hc \quad (2)$$

wherein AD is an apparent density (g/cm$^3$); FR is a flow rate (sec/50 g); and Hc is a coercive force (Oe).

2. The carrier for an electrophotographic developer according to claim 1, which has a coercive force Hc of 12 to 60 Oe.

3. The carrier for an electrophotographic developer according to claim 1, which has a saturation magnetization of 20 to 45 emu/g in an applied magnetic field of 3000 Oe.

4. The carrier for an electrophotographic developer according to claim 1, which has a volume average particle size of 30 to 80 $\mu$m.

5. The carrier for an electrophotographic developer according to claim 1, which has an electric current of 5 $\mu$A or less.

6. The carrier for an electrophotographic developer according to claim 1, which comprises ferrite core particles and a resin coat, the resin containing at least one of a unit represented by formula (I) and a unit represented by formula (II):

(I)

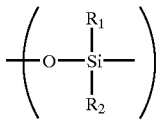

(II)

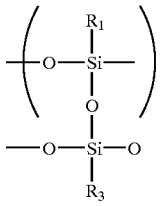

where $R_1$, $R_2$, and $R_3$ each represent a hydrogen atom, a halogen atom, a hydroxyl group, a methoxy group, an alkyl group having 1 to 4 carbon atoms or a phenyl group.

7. An electrophotographic developer comprising a carrier according to claim 1 and a toner.

8. An electrophotographic developer comprising a carrier according to claim 2 and a toner.

9. An electrophotographic developer comprising a carrier according to claim 3 and a toner.

10. An electrophotographic developer comprising a carrier according to claim 4 and a toner.

11. An electrophotographic developer comprising a carrier according to claim 5 and a toner.

12. An electrophotographic developer comprising a carrier according to claim 6 and a toner.

* * * * *